United States Patent [19]

Perez-Alonso

[11] 4,228,666

[45] Oct. 21, 1980

[54] SAFETY LATCHES FOR PORTFOLIOS, BAGS, SUITCASES AND THE LIKE

[76] Inventor: Domingo Perez-Alonso, Avenida de las Torres No. 178, Zona Industrial Tlatilco, Edo. Mexico

[21] Appl. No.: 26,395

[22] Filed: Apr. 2, 1979

[51] Int. Cl.³ ..... E05B 65/52

[52] U.S. Cl. ..... 70/67; 70/207

[58] Field of Search ..... 70/63, 64, 67, 69, 70, 70/71, 207, 209; 190/55 A, 56, 57; 16/110 R

[56] References Cited

U.S. PATENT DOCUMENTS

| | | | |
|---|---|---|---|
| 1,374,126 | 4/1921 | Walter | 190/57 |
| 1,826,976 | 10/1931 | Wright | 190/55 A |

FOREIGN PATENT DOCUMENTS

| | | | |
|---|---|---|---|
| 837299 | 4/1952 | Fed. Rep. of Germany | 190/57 |
| 185703 | 8/1960 | Netherlands | 190/57 |

*Primary Examiner*—Robert L. Wolfe

*Attorney, Agent, or Firm*—Ladas & Parry

[57] ABSTRACT

The present invention is related with improvements in safety closures for cases, bags, valises and the like, of the kind incorporating a male latch pin which is inserted into a female receptacle under pressure and which can be retained in the closed position by the action of a ratchet mechanism which is incorporated into a joined handle by means of a hinge mechanism of the lid portion of a container such as a suitcase.

4 Claims, 8 Drawing Figures

FIG. 1
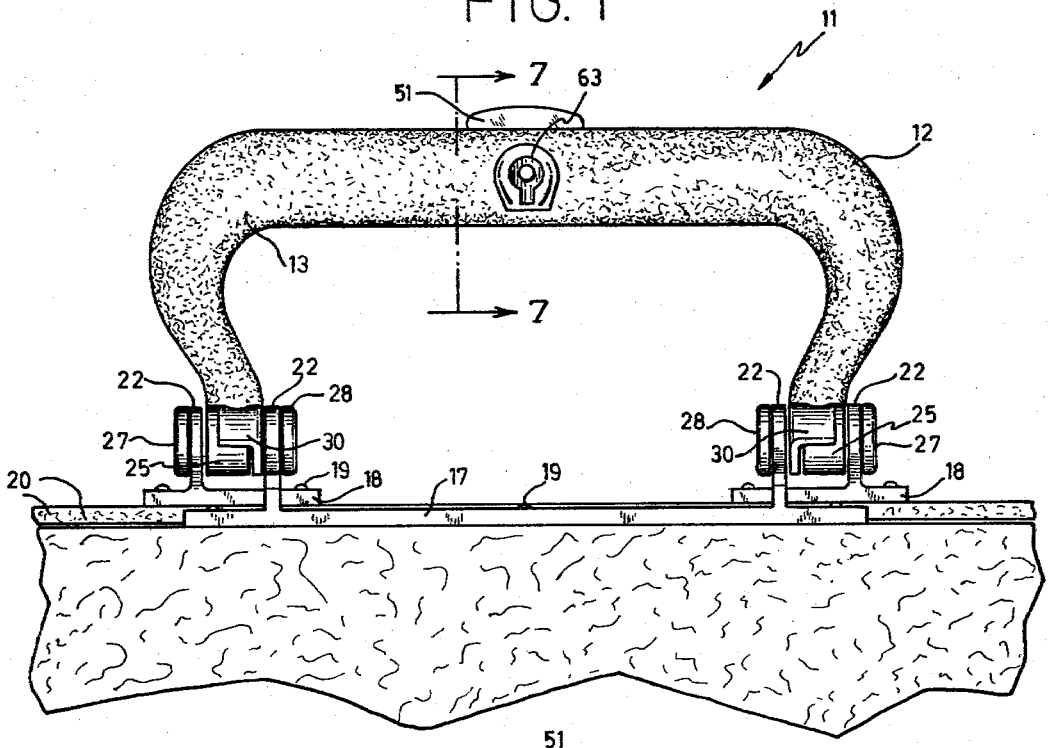
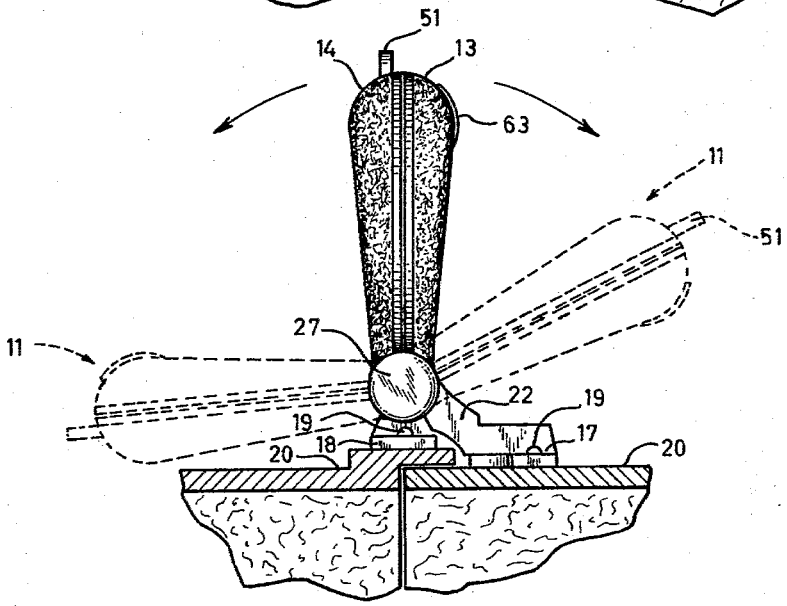
FIG. 2

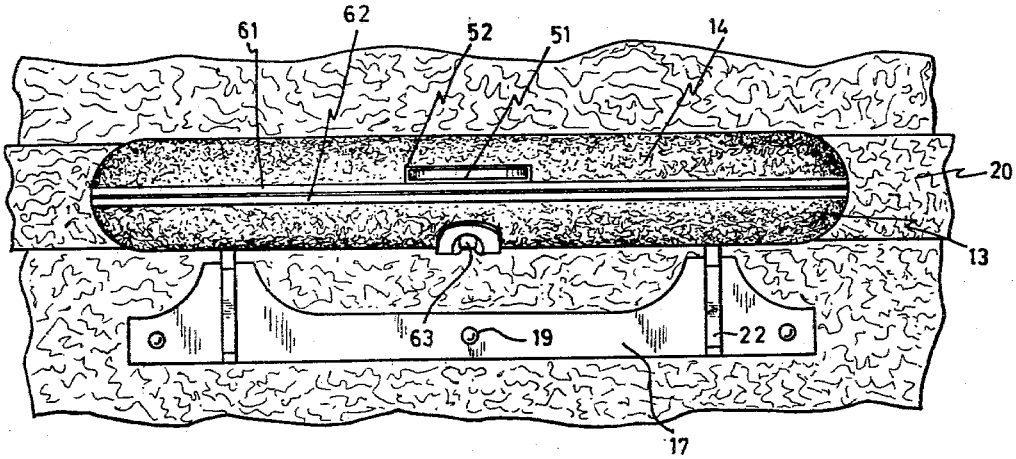
FIG. 6
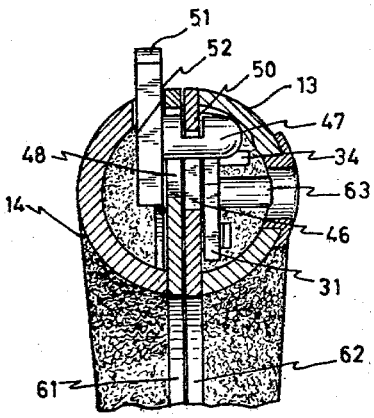
FIG. 7
FIG. 8
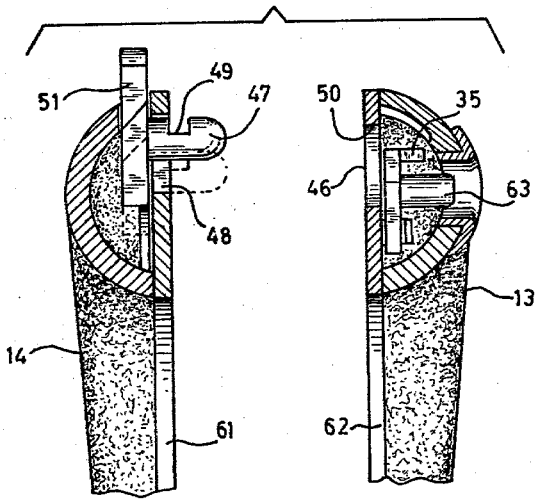

SAFETY LATCHES FOR PORTFOLIOS, BAGS, SUITCASES AND THE LIKE

BACKGROUND OF THE INVENTION

Hitherto the safety latches for attache cases, bags, suitcases and the like have consisted of latches which are independent of the handle or grip of the case, bag, suitcase or the like, and hence it is possile for them to come open without the person carrying them being aware of it.

Latches for this kind of article have generally consisted of a pressure catch penetrating a receptacle, the catch being on one side of the case or bag and the receptacle for the catch on the opposite side.

These conventional mechanisms include a number of elaborate variations including the double catch, one on each side, located near the corners of the case or bag, which may be hinged at one end and biassed with springs toward the open position and which, when pressed together engage coinciding catches on the opposite side of the case.

The foregoing latching mechanism are sometimes provided with a key to enable the user to lock or unlock the case, bag, valise, or the like.

None of the mechanisms known to date has included a handle which is divided in the middle lengthwise thereof and having in each of the opposed faces thereof a latch and receiver therefore, respectively, such that when the case or the like is closed the two opposed sides of the handle are likewise brought together thereby producing the safety closure, and such that when the user holds the handle in his hand it is totally impossible for any other person to open the case or bag, and further such that the latch is concealed by the hand of the user, thereby obviating the usually unattractive appearance of safety latches.

SUMMARY OF THE INVENTION

In consequence of the foregoing, it is one object of this invention to provide an improved safety closure located in the handle or girp of a valise, bag, case or the like, such that the closure is concealed when the user takes the handle of the article in his hand.

Another object of this invention is that of providing an improved safety latch for cases, bags, valises and the like comprising a handle which is divided lengthwise down the middle thereof, each half thereof being joined to the corresponding edge of the two sides or cover portions normally making up a case or bag, each of the opposing faces of the handle including a latch member and a receptacle respectively which are connected when the two halves of the divided handle are brought together.

A further object of this invention is to provide an improved safety latch for cases, bags, and the like which is extremely simple and rigid and which, when a button or trigger is pressed on the upper side of a handle, will permit opening the same along its central division, thereby opening the container upon which the latch is mounted.

The improved safety closure for cases, bags, valises and the like of the present invention consists of a handle which is split along its middle portion, each one of the halves being connected pivotally and permanently upon one of the sides of the valises or the like to which the closure is adapted. One of the pivot structures of one of the handle halves consists of a hollow cylinder having one of its walls slotted and adapted to pivot with one of its ends in a supporting bracket.

The other of the structures which pivotally supports the other half of the handle consists of a pin of such diameter that it is able to be introduced into the slot in the said cylinder which comprises the other pivoted structure cited of the other handle half, so that when the valise, bag or the like is closed, the pin penetrates inside the slot in the cylinder and the whole constitute a single strong structure for pivoting and closing for the entire handle as an assembly. It also includes in the opposed faces of the handle halves respective latch and receptacle members which engage one another by means of mere pressure and which can be disconnected by pressing a button to oppose the action of a spring. In one of the embodiments a key is included which actuates a sliding latch plate controlled by a spring for engaging the latch, thus securing the closure.

In addition, one of the confronting faces includes a spring with a pin which permanently obliges the two confronting faces to separate, and absorbs any maladjustment and facilities opening and closing by the user.

These and other objects to be attained in the practice of this invention will be more fully understood and appreciated in reading the following description of the invention, which refers to the accompanying drawings of the preferred embodiment of the invention, in which:

BRIEF DESCRIPTION OF THE DRAWINGS

FIG. 1 is a view in vertical frontal elevation of the improved safety latch for bags, suitcases and the like of the present invention.

FIG. 2 is a view in lateral elevation or profile of the safety latch shown in FIG. 1, showing with dotted lines the positions of the handle as it rotates pivotally around its hinges.

FIG. 6 is an upper plan view showing the closure mechanism of FIG. 5, in its closed position.

FIG. 7 is a coross-sectional view taken along lines 7—7 of FIG. 1.

FIG. 8 is a view similar to that of FIG. 7 but showing the closure in its open and disengaged position.

DETAILED DESCRIPTION OF THE INVENTION

Figure 3:
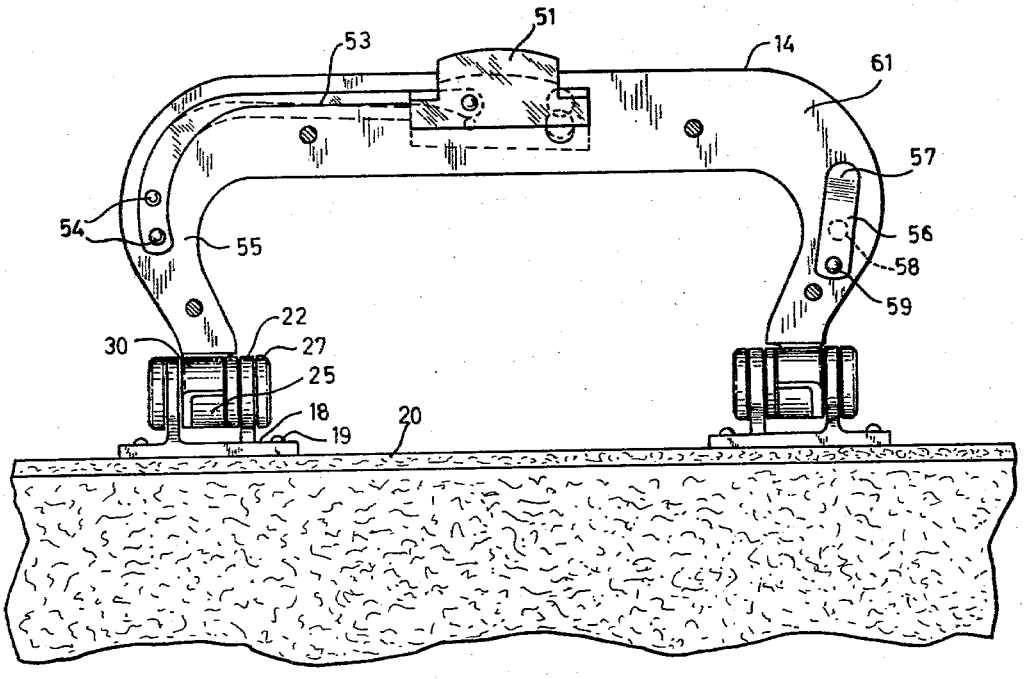
FIG. 3 is a view of the handle in vertical rear elevation similar to that of FIG. 1, with the cover removed to show the release button and the spacing and locating spring for the halves of the said closure.

Now referring to the accompanying drawings, the improved closure 11 of this invention consists essentially of a handle 12 which is divided lengthwise into symmetrical halves 13 and 14, which are pivotally supported respectively by structures 15 and 16, each of which respectively includes plates 17 and 18 which are mounted by pins 19 to the half covers 20 of a briefcase, valise, bag or the like in a manner such that they will coincide. The said structures 15 and 16 also include braces or perpendicular support plates 22 through which pass rotatingly transverse pins 23 and 24. Pins 24, on the opposite sides of braces 22, include hollow cylinders 25 which are pivotally connected and have longitudinal slot 26, and incorporate heads or cylindrical washers 28 outside of braces 28; similarly pins 23 have on one side of brace 22 heads or cylindrical washers 28 and on the other side pass through a cylindrical portion of handle 29, joined to a cylindrical cover 30. It follows from the foregoing that when the edges 20 of the case are closed as is illustrated in FIGS. 1 and 2, pin 23 passes through slot 26 and is received inside of cylinder 25, and cover 30 is thus mounted upon the said cylinder 25, thereby forming a unitary support of hings and closure upon which the two halves of the handle 13 and 14 rotate; halve 13 of the latter has an elongated plate 31 housed inside it which can slide a certain distance, as illustrated with dotted lines 32 in FIG. 4, when a key is inserted in an elongated perforation 33 pushing upon certain portions of plates 34 and 35 which are bent and cut out to form recesses 36 in the said plate 31. Plate 31 is retained against the inner wall 37 of handle half 13 by the action of a spring 38 which is fixed at one of its ends 39 and free at the other end, encluding a hump or ridge 40 which is inserted into a pair of slots 41 and 42 formed like windows in the end portion of plate 31: thus the two positions of the movement of plate 31 are defined.

Figure 4:
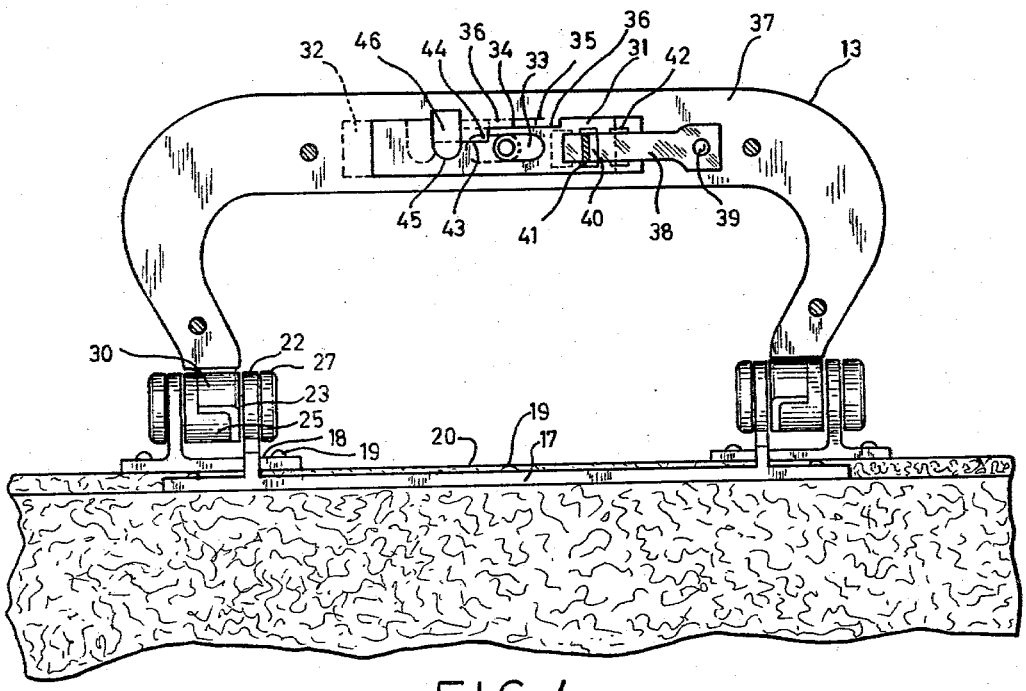
FIG. 4 is a view similar to that of FIG. 3 except that it is taken from the opposite side of the handle, showing the latch mechanism controlled by a spring and operated with a key.
Figure 5:
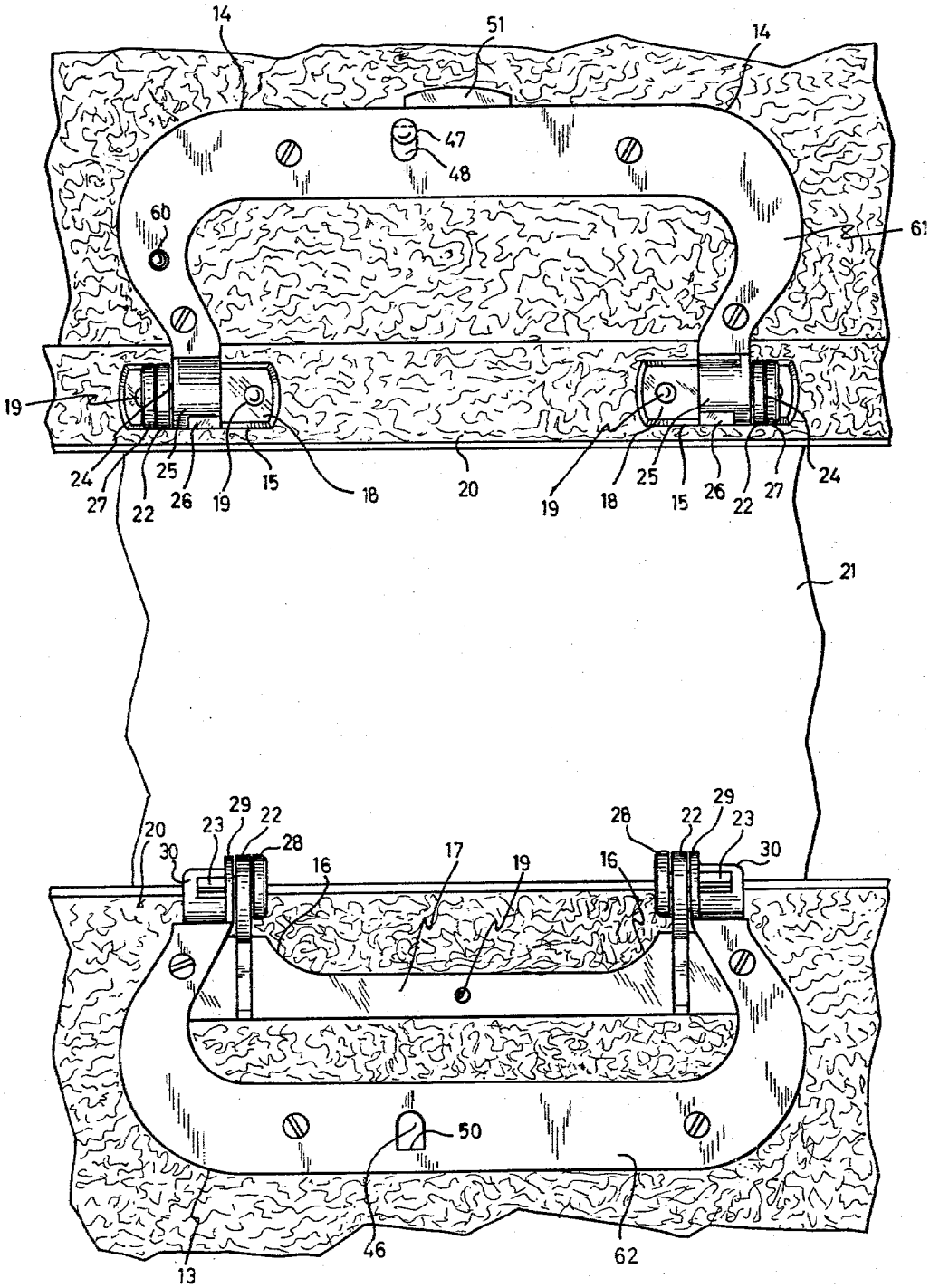
FIG. 5 is an upper plan view with the handle halves opened and laid out to opposite sides, in which the pivot mechanism of each of the halves is clearly shown, connectable to form a single mechanism, consisting of a cylinder which is slotted, on one side, and on the other of a pin which can be connected in the said slot.

In addition to recess 36, the said plate includes another recess 43 which is larger than recess 36 and forms a step 44; this recess 43 includes at its end a curved portion 45, which in the open position of the closure illustrated in FIG. 4 follows the same configuration as perforation 46, into which the latch pin 47 is inserted, extending outward from elongated slot 48 on the opposite half 14 of the handle; this latch pin 47 can be identified more easily in FIG. 8 and has a rounded end and a slot or recess 49 which extends nearly to the center thereof, and which upon closing latches upon the upper straight edge 50 of perforation 46 of the opposite handle half. As can be observed in FIG. 7, pin 47 is mounted on button or laminar actuator 51 which extends upward out of elongated slot 52 at the top of handle half 14, urged upward by spring 53 mounted at one end upon the said actuator 51 and at the other end by pins 54 to lateral portion or leg 55 of handle half 14. This handle half 14 also includes on the opposite lateral portion or leg a spring 56 connected to the leg by one of its ends 57 and having on either side thereof a pair of protuberances 58 and 59, of which 59 extends outward through small circular orifice 60 in plate 61 or cover of handle 14. This said pin 60 is continously pressing upon cover plate 62 of the opposite handle half 13 when they are in contact with each other in the closed position. The said pin acts as a spacer and absorbs any clearance or space which there may be between the two halves and at the same time it functions as an impeller so that when the two handle halves 13 and 14 are disconnected from each other they tend to separate, making it easier for the user to perform the operation of opening the case or valise 21, other apparatus in which they may be mounted.

It is clear from the preceding that when plates 61 and 62 of the handle halves are placed in contact the latch or slotted pin 47 engages its slot 49 with the straight edge 50 of elongated perforation 46; furthermore, when the key is inserted in keyhole 63, making it penetrate through elongated passage 33 and pressing against bent plates 34, elongated locking plate 31 is caused to move, making the latch catch in recess 43 and causing the hump or ridge 40 of spring 38 travel from window or slot 41 to window or slot 42. Thereby latch 47 is seized and cannot be moved even if button 51 is depressed, thus accomplishing the safety closure, since when the user puts his hand around handle 12, the lock is concealed, and the handle is able to rock round a hinge structure.

While the foregoing description is drawn to a specific embodiment of the invention, it will be understood by all persons skilled in the subject matter that any changes in shape and detail will be within the scope and spirit of the present invention.

What is claimed is:

1. Improvements in safety closures for cases, bags, valises and the like, of the kind incorporating a male latch pin which is inserted into a female receptacle under pressure and which can be retained in the closed position by the action of a ratchet mechanism which is incorporated into a joined handle by means of a hinge mechanism on the lid portion of a container such as a suitcase, wherein the handle is divided lengthwise down its middle and each of the handle halves is joined to one of the confronting cover portions of the container by means of a hinge structure comprising a plate secured as with pins to each of the confronting portions of the container and having a perpendicular support brace, on one of the handle halves a pin passing through said brace and on the other handle half another pin passing through the corresponding brace and securing thereto a hollow slotted cylinder into which cylinder the pin of the opposite handle half can be inserted and housed therein, the latter pin also passing through a portion of the handle on the opposite side of said brace, said portion of the handle having a cover such that when closed it rests upon the cylinder of the other handle half, thereby forming between them a single hinge device for the two handle halves; and in which from one of the handle halves there protudes a slotted latch pin which is inserted into an elongated perforation of the other handle half and locks upon the upper edge thereof so long as a button projecting from a slot in the first handle half referred to is not depressed; and in that it likewise includes a pin which extends outward from a perforation in the first handle half and yieldingly presses upon the other handle half when the handle halves are in the closed position, thus taking up any clearance or space between the handle halves in their closed position, and yieldingly pressing one handle half out of contact with the other handle half to facilitate the opening of the suitcase; and in that one of the handle halves includes a keyhole and lock which by means of a key actuates a bar which prevents the button on the handle half from being pressed down and thus maintains the safety closure in closed position locked with the key.

2. Improvements in safety closures for cases, bags, valises and the like as set forth in claim 1, wherein one of the handle halves includes in its cover which will bear against the other handle half an elongated passage occupied by a slotted latch pin perpendicularly connected to a button which in turn is connected at one of its ends to a spring secured to one of the sides of the handle by means of locking pins, the button projecting from an enlongated slot formed in the upper portion of the handle half.

3. Improvements in safety closure as set forth in claim 1, wherein one of the handle halves includes a spring joined to its end on the inner surface of the cover of the handle half, and includes on each side and has at its other end on each side a pair of projections similar to small pins, one of which projects from a circular opening in the cover of the handle half elastically biassing the opposite handle half outward when the two handle halves are in their closed position.

4. Improvements in safety closures as set forth in any of the preceding claims, wherein the handle half opposite the slotted latch pin has a sliding lock plate with an elongated slot which coincides with the keyhole when in the open position and has a pair of incisions with tabs on one of the edges of a portion of said plate which provide perpendicular projections which can be connected to the corresponding portion of the key for causing the lock plate to slide lengthwise of the handle; the said plate also presents a recess of appropriate width such that upon sliding it prevents the slotted latch pin caught on the upper straight surface of the elongated passage coinciding with the latch on the other handle half from sliding down and thus maintains the mechanism in its locked position; this said recess produced by the tab for engaging the pin exhibits on its end a curved recess which coincides with the enlongated passage to permit the free travel of the pin of the opposite handle half in the open position, and wherein the plate is held against the cover of the handle half by the action of a spring having a bend which is inserted respectively into either of two openings in the locking plate, one being for the closed and the other for the open position thereof.

* * * * *